US009850886B2

(12) United States Patent
Nakaima et al.

(10) Patent No.: US 9,850,886 B2
(45) **Date of Patent: *Dec. 26, 2017**

(54) VARIABLE DISPLACEMENT SWASH-PLATE COMPRESSOR

(71) Applicant: KABUSHIKI KAISHA TOYOTA JIDOSHOKKI, Aichi-ken (JP)

(72) Inventors: Hiroyuki Nakaima, Kariya (JP); Kengo Sakakibara, Kariya (JP); Yusuke Yamazaki, Kariya (JP); Hideharu Yamashita, Kariya (JP); Shinya Yamamoto, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 271 days.

This patent is subject to a terminal disclaimer.

(21) Appl. No.: 14/947,167

(22) Filed: Nov. 20, 2015

(65) Prior Publication Data

US 2016/0153437 A1 Jun. 2, 2016

(30) Foreign Application Priority Data

Nov. 27, 2014 (JP) ..... 2014-239921

(51) Int. Cl.
*F04B 27/14* (2006.01)
*F04B 27/10* (2006.01)
(Continued)

(52) U.S. Cl.
CPC ..... *F04B 27/14* (2013.01); *F04B 27/0895* (2013.01); *F04B 27/1054* (2013.01); *F04B 27/1072* (2013.01); *F04B 27/18* (2013.01)

(58) Field of Classification Search
CPC ..... F01B 3/0026; F01B 3/102; F03C 1/0686; F04B 27/0895; F04B 27/1054;
(Continued)

(56) References Cited

U.S. PATENT DOCUMENTS 4,037,993 A 7/1977 Roberts
4,061,443 A 12/1977 Black et al.
(Continued)

FOREIGN PATENT DOCUMENTS

EP 2 423 507 2/2012
JP 52-131204 11/1977
JP 62-225782 10/1987

OTHER PUBLICATIONS

Extended European Search Report for EP 15195803.0 dated May 3, 2016.

(Continued)

*Primary Examiner* — Devon Kramer
*Assistant Examiner* — Joseph Herrmann
(74) *Attorney, Agent, or Firm* — Greenblum & Bernstein, P.L.C.

(57) ABSTRACT

A variable displacement swash-plate compressor includes an actuator that changes the inclination angle of a swash plate. The actuator includes a movable body that moves along a drive shaft axis. The movable body includes an acting portion that pushes the swash plate. The swash plate includes a receiving portion that contacts and is pushed by the acting portion. The acting portion and the receiving portion contact each other at an acting position. A bottom dead center associated part for positioning the piston at a bottom dead center is defined on the swash plate. When the drive shaft and the acting position are viewed from a direction that is perpendicular to a top dead center plane containing the top dead center associated part and the drive shaft axis, the acting position is defined at a position overlapping with the drive shaft regardless of the inclination angle.

7 Claims, 12 Drawing Sheets

(51) Int. Cl.
*F04B 27/18* (2006.01)
*F04B 27/08* (2006.01)

(58) Field of Classification Search
CPC ..... F04B 27/1072; F04B 27/14; F04B 27/10; F04B 27/18
See application file for complete search history.

(56) References Cited

U.S. PATENT DOCUMENTS

| | | | | |
|---|---|---|---|---|
| 4,105,370 | A | 8/1978 | Brucken et al. | |
| 5,000,666 | A * | 3/1991 | Esaki | F04B 27/18 417/222.2 |
| 5,370,503 | A | 12/1994 | Terauchi | |
| 6,957,604 | B1 * | 10/2005 | Tiedemann | F04B 1/295 417/222.1 |
| 7,320,576 | B2 * | 1/2008 | Enomoto | F04B 27/1036 417/222.1 |
| 8,152,483 | B2 * | 4/2012 | Kawamura | F04B 27/1072 417/269 |
| 9,651,034 | B2 * | 5/2017 | Nakaima | F04B 27/14 |
| 2014/0294614 | A1 * | 10/2014 | Ota | F04B 27/1054 417/222.2 |

OTHER PUBLICATIONS

U.S. Appl. No. 14/947,143 to Nakaima et al., filed Nov. 20, 2015.
U.S. Appl. No. 14/947,191 to Nakaima et al., filed Nov. 20, 2015.

* cited by examiner

VARIABLE DISPLACEMENT SWASH-PLATE COMPRESSOR

BACKGROUND OF THE INVENTION

The present invention relates to a variable displacement swash-plate compressor.

Japanese Laid-Open Patent Publication No. 52-131204 discloses a conventional variable displacement swash-plate compressor (hereinafter, referred to as a compressor). The compressor includes a swash plate chamber, cylinder bores, a suction chamber, and a discharge chamber, which are provided in the housing. A drive shaft is rotationally supported in the housing. The swash plate chamber accommodates a swash plate, which is rotational through rotation of the drive shaft. The swash plate has a through hole. A link mechanism is located between the drive shaft and the swash plate. The link mechanism allows the inclination angle of the swash plate to be changed. The inclination angle is the angle of the swash plate in relation to a direction perpendicular to the axis of the drive shaft. Each cylinder bore reciprocally accommodates a piston. A conversion mechanism reciprocates each of the pistons in the associated one of the cylinder bores by the stroke corresponding to the inclination angle through rotation of the swash plate. A top dead center associated part for positioning each piston at the top dead center is defined on the swash plate. The inclination angle of the swash plate is changed by an actuator. The actuator is controlled by a control mechanism. The control mechanism includes a pressure regulation valve.

The link mechanism includes a lug member, a hinge ball, and a link. The lug member is located in the swash plate chamber and is fixed to the drive shaft. The hinge ball is fitted about the drive shaft to be arranged in the through hole of the swash plate. This causes the outer circumferential surface of the hinge ball to contact the through hole. The link is provided between the lug member and the swash plate. The link connects the swash plate to the lug member, so that the swash plate is permitted to pivot.

The actuator includes the lug member, a movable body, and a control pressure chamber. The movable body has a cylindrical shape. The movable body is fitted about the drive shaft to be arranged between the lug member and the hinge ball. When the movable body and the hinge ball contact each other, the movable body is engaged with the swash plate via the hinge ball. When moving along the drive shaft axis, the movable body changes the inclination angle of the swash plate. The control pressure chamber, which is defined by the lug member and the movable body, uses its internal pressure to move the movable body.

In this compressor, when the control mechanism connects the discharge chamber and the control pressure chamber with each other using the pressure regulation valve, the pressure in the control pressure chamber is increased. This moves the movable body along the axis of the drive shaft and pushes the hinge ball along the axis of the drive shaft. Accordingly, the hinge ball is moved along the axis of the drive shaft, and the swash plate slides on the hinge ball in the direction reducing the inclination angle. This allows the displacement of the compressor per rotation of the drive shaft to be reduced.

However, in the above described compressor, the movable body of the actuator and the swash plate are engaged with each other via the hinge ball. Thus, the size of the entire compressor needs to be increased to increase the size of the movable body so that the movable body is easily moved with a great thrust.

When decreasing the inclination angle of the swash plate in the compressor, the movable body pushes the swash plate via the hinge ball. The tolerance during manufacture is likely to vary contacting positions between the outer circumferential surface of the hinge ball and the swash plate. Accordingly, when the movable body pushes the hinge ball, the direction of the load acting on the swash plate is likely to change. Thus, the movable body cannot smoothly move the hinge ball along the axis of the drive shaft, and the movable body cannot stably decrease the inclination angle of the swash plate. Also, the orientation of the movable body tends to be unstable, which can result in pressure leakage in the control pressure chamber. In this case, the displacement cannot be quickly changed in response to changes in the driving state of machinery on which the compressor is mounted, such as a vehicle, and high controllability cannot be achieved.

SUMMARY OF THE INVENTION

An objective of the present invention is to provide a variable displacement swash-plate compressor that achieves a sufficient controllability while minimizing the size.

To achieve the foregoing objective and in accordance with one aspect of the present invention, a variable displacement swash-plate compressor is provided that includes a housing having a swash plate chamber and a cylinder bore, a drive shaft that is rotationally supported by the housing, a swash plate that is supported in the swash plate chamber and is rotational by rotation of the drive shaft, a link mechanism, a piston, a conversion mechanism, an actuator, and a control mechanism. The link mechanism is arranged between the drive shaft and the swash plate, and allows an inclination angle of the swash plate to be changed with respect to a direction perpendicular to a drive shaft axis of the drive shaft. The piston is reciprocally received in the cylinder bore. The conversion mechanism causes the piston to reciprocate in the cylinder bore by a stroke corresponding to the inclination angle of the swash plate through rotation of the swash plate. The actuator is configured to change the inclination angle. The control mechanism controls the actuator. The link mechanism includes a lug member that is located in the swash plate chamber and is fixed to the drive shaft and a transmitting member that transmits rotation of the lug member to the swash plate. The swash plate has a through hole, which slides on an outer circumference of the drive shaft in response to changes in the inclination angle. The swash plate is guided by the link mechanism and the through hole along the drive shaft axis and in a direction of the inclination angle, thereby changing the inclination angle. The actuator includes the lug member, a movable body, and a control pressure chamber. The movable body is located between the lug member and the swash plate and is configured to rotate integrally with the swash plate and to move along the drive shaft axis, thereby changing the inclination angle. The control pressure chamber is defined by the lug member and the movable body and is configured such that pressure in the control pressure chamber is changed by the control mechanism to move the movable body. The movable body includes an acting portion that is configured to push the swash plate with the pressure in the control pressure chamber. The swash plate includes a receiving portion that contacts and is pushed by the acting portion. The acting portion and the receiving portion contact each other at an acting position. A top dead center associated part for positioning the piston at a top dead center is defined on the swash plate. When the drive shaft and the acting position are viewed from a direction that is perpendicular to a top dead center plane containing the top dead center associated part and the drive shaft axis, the acting position is defined at a position overlapping with the drive shaft regardless of the inclination angle.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

First to third embodiments of the present invention will now be described with reference to the drawings. Compressors according to the first to third embodiments are variable displacement swash-plate compressors with single-headed pistons. These compressors are installed in vehicles and are each included in the refrigeration circuit in the air conditioner for the vehicle.

First Embodiment

Figure 1:
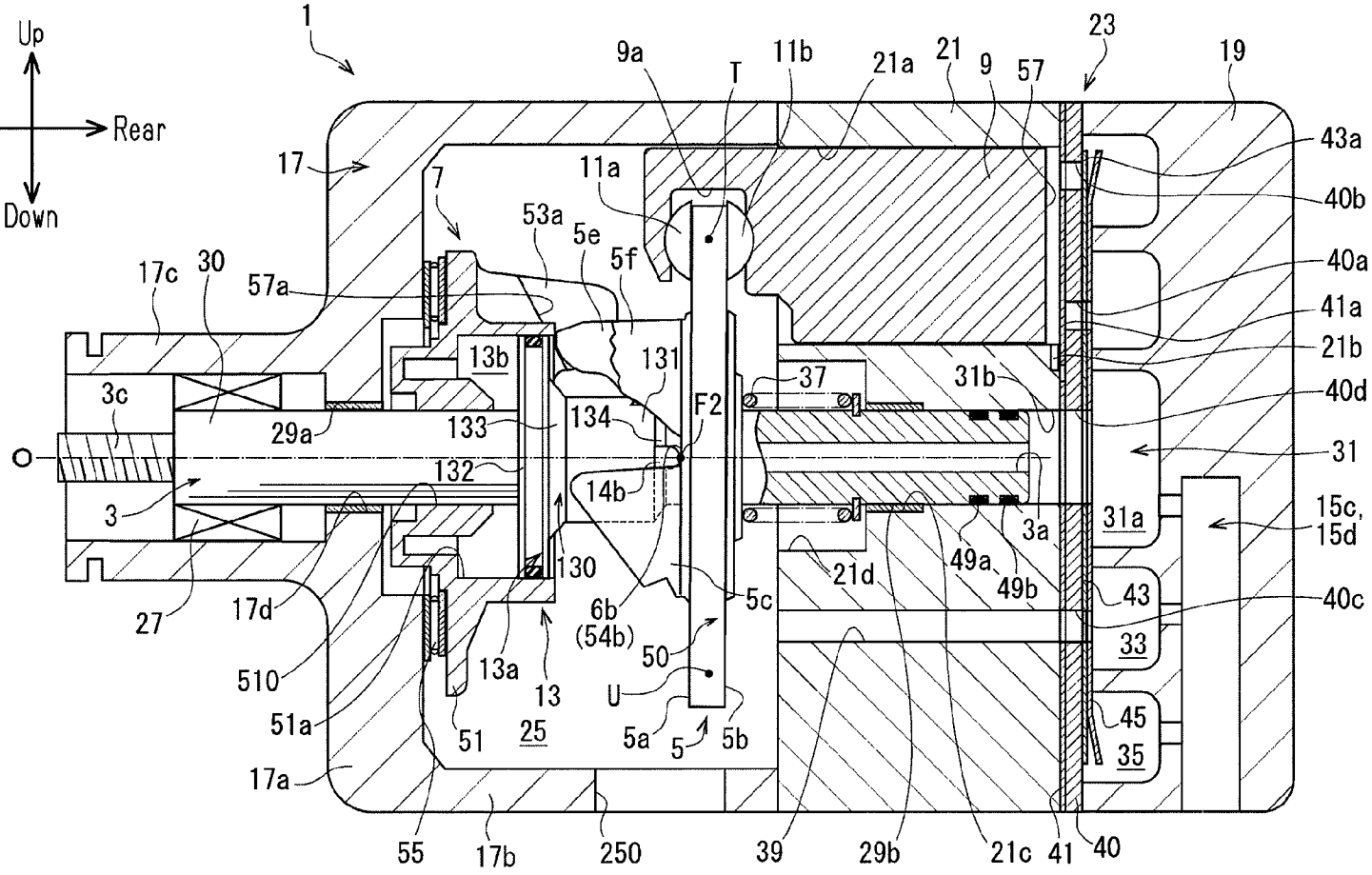
FIG. 1 is a cross-sectional view of a compressor according to a first embodiment at the minimum displacement.
Figure 2:
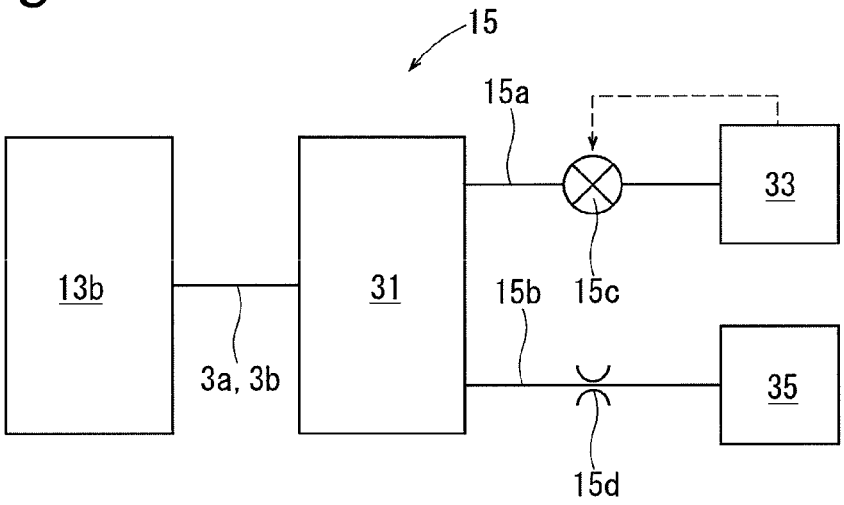
FIG. 2 is a schematic diagram showing the control mechanism of the compressor according to the first embodiment.

As shown in FIG. 1, the compressor according to the first embodiment includes a housing 1, a drive shaft 3, a swash plate 5, a link mechanism 7, pistons 9, pairs of shoes 11*a*, 11*b*, an actuator 13, and a control mechanism 15, which is illustrated in FIG. 2.

As shown in FIG. 1, the housing 1 has a front housing member 17 at a front position in the compressor, a rear housing member 19 at a rear position in the compressor, and a cylinder block 21 and a valve assembly plate 23, which are arranged between the front housing member 17 and the rear housing member 19.

The front housing member 17 includes a front wall 17*a*, which extends in the vertical direction of the compressor on the front side, and a circumferential wall 17*b*, which is integrated with the front wall 17*a* and extends rearward from the front of the compressor. The front housing member 17 has a substantially cylindrical cup shape with the front wall 17*a* and the circumferential wall 17*b*. Furthermore, the front wall 17*a* and the circumferential wall 17*b* define a swash plate chamber 25 in the front housing member 17.

The front wall 17*a* has a boss 17*c*, which projects forward. The boss 17*c* accommodates a shaft sealing device 27. The boss 17*c* has a first shaft hole 17*d*, which extends in the front-rear direction of the compressor. The first shaft hole 17*d* accommodates a first slide bearing 29*a*.

The circumferential wall 17*b* has an inlet 250, which communicates with the swash plate chamber 25. The swash plate chamber 25 is connected to a non-illustrated evaporator through the inlet 250. Since low-pressure refrigerant gas that has passed through the evaporator flows into the swash plate chamber 25 via the inlet 250, the pressures in the swash plate chamber 25 is lower than the pressure in a discharge chamber 35, which will be discussed below.

A part of the control mechanism 15 is received in the rear housing member 19. The rear housing member 19 includes a first pressure regulation chamber 31*a*, a suction chamber 33, and the discharge chamber 35. The first pressure regulation chamber 31*a* is located in the central part of the rear housing member 19. The discharge chamber 35 has an annular shape and is located in a radially outer part of the rear housing member 19. Also, the suction chamber 33 has an annular shape between the first pressure regulation chamber 31*a* and the discharge chamber 35 in the rear housing member 19. The discharge chamber 35 is connected to a non-illustrated outlet.

The cylinder block 21 includes cylinder bores 21*a*, the number of which is the same as that of the pistons 9. The cylinder bores 21*a* are arranged at equal angular intervals in the circumferential direction. The front end of the each cylinder bore 21*a* communicates with the swash plate chamber 25. The cylinder block 21 also includes retainer grooves 21*b*, which limit the lift of suction reed valves 41*a*, which will be discussed below.

The cylinder block 21 further includes a second shaft hole 21*c*, which communicates with the swash plate chamber 25 and extends in the front-rear direction of the compressor. The second shaft hole 21*c* accommodates a second slide bearing 29*b*. The first slide bearing 29*a* and the second slide bearing 29*b* may be replaced by rolling-element bearings.

The cylinder block 21 further has a spring chamber 21*d*. The spring chamber 21*d* is located between the swash plate chamber 25 and the second shaft hole 21*c*. The spring chamber 21*d* accommodates a restoration spring 37. The restoration spring 37 urges the swash plate 5 forward of the swash plate chamber 25 when the inclination angle is minimized. The cylinder block 21 also includes a suction passage 39, which communicates with the swash plate chamber 25.

The valve assembly plate 23 is located between the rear housing member 19 and the cylinder block 21. The valve assembly plate 23 includes a valve base plate 40, a suction valve plate 41, a discharge valve plate 43, and a retainer plate 45.

The valve base plate 40, the discharge valve plate 43, and the retainer plate 45 include suction ports 40*a*, the number of which is equal to that of the cylinder bores 21*a*. Furthermore, the valve base plate 40 and the suction valve plate 41 include discharge ports 40*b*, the number of which is equal to that of the cylinder bores 21*a*. The cylinder bores 21*a* communicate with the suction chamber 33 through the suction ports 40*a* and communicate with the discharge chamber 35 through the discharge ports 40*b*. Furthermore, the valve base plate 40, the suction valve plate 41, the discharge valve plate 43, and the retainer plate 45 include a first communication hole 40*c* and a second communication hole 40*d*. The first communication hole 40*c* connects the suction chamber 33 to the suction passage 39. This causes the swash plate chamber 25 to communicate with the suction chamber 33.

The suction valve plate 41 is provided on the front surface of the valve base plate 40. The suction valve plate 41 includes suction reed valves 41*a*, which are allowed to selectively open and close the suction ports 40*a* by elastic deformation. The discharge valve plate 43 is located on the rear surface of the valve base plate 40. The discharge valve plate 43 includes discharge reed valves 43*a*, which are allowed to selectively open and close the discharge ports 40*b* by elastic deformation. The retainer plate 45 is provided on the rear surface of the discharge valve plate 43. The retainer plate 45 limits the maximum opening degree of the discharge reed valves 43*a*.

The drive shaft 3 has a cylindrical outer circumferential surface 30. The drive shaft 3 is inserted in the boss 17*c* toward the rear of the housing 1. The front portion of the drive shaft 3 is supported by the shaft sealing device 27 in the boss 17*c* and is supported by the first slide bearing 29*a* in the first shaft hole 17*d*. The rear portion of the drive shaft 3 is supported by the second slide bearing 29*b* in the second shaft hole 21*c*. In this manner, the drive shaft 3 is supported by the housing 1 to be rotational about the drive shaft axis O. The second shaft hole 21*c* and the rear end of the drive shaft 3 define a second pressure regulation chamber 31*b*. The second pressure regulation chamber 31*b* communicates with the first pressure regulation chamber 31*a* through the second communication hole 40*d*. The first and second pressure regulation chambers 31*a*, 31*b* constitute a pressure regulation chamber 31.

O-rings 49*a*, 49*b* are provided on the rear end of the drive shaft 3. The O-rings 49*a*, 49*b* are located between the drive shaft 3 and the second shaft hole 21*c* to seal off the swash plate chamber 25 and the pressure regulation chamber 31 from each other.

The link mechanism 7, the swash plate 5, and the actuator 13 are mounted on the drive shaft 3. The link mechanism 7 includes first and second swash plate arms 5*e*, 5*f* provided on the swash plate 5 shown in FIG. 3, a lug plate 51 shown in FIG. 4, and first and second lug arms 53*a*, 53*b* provided on the lug plate 51. The first and second swash plate arms 5*e*, 5*f* correspond to transmitting members. The lug plate 51 corresponds to a lug member. For illustrative purposes, part of the second swash plate arm 5*f* is omitted by using a break line.

Figure 3:
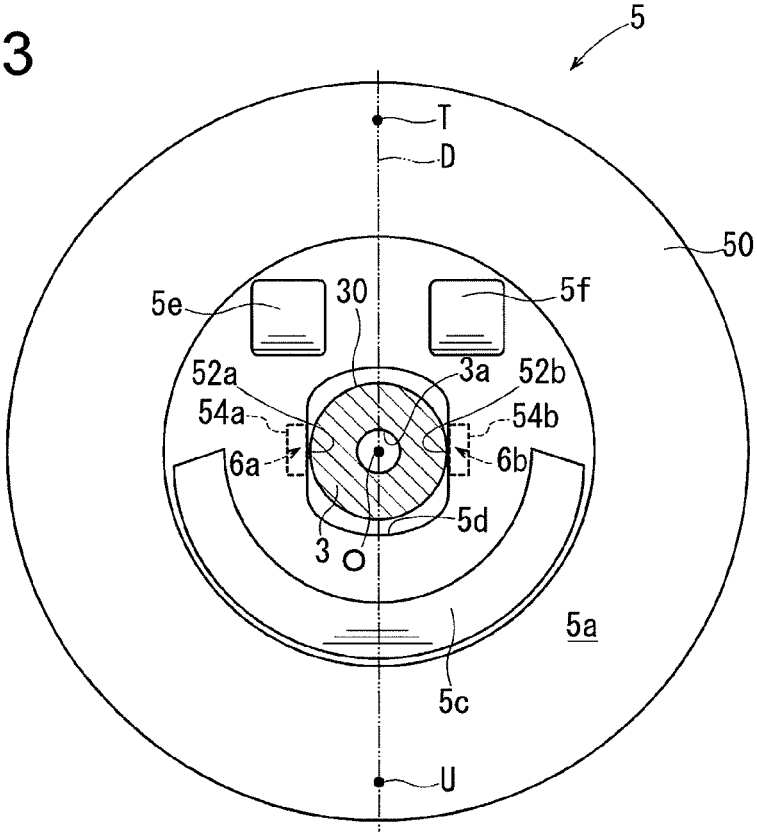
FIG. 3 is a schematic front view of the swash plate of the compressor according to the first embodiment.

As shown in FIG. 3, the swash plate 5 has a swash plate main portion 50, a swash plate weight 5*c*, and the first and second swash plate arms 5*e*, 5*f*.

Figure 8:
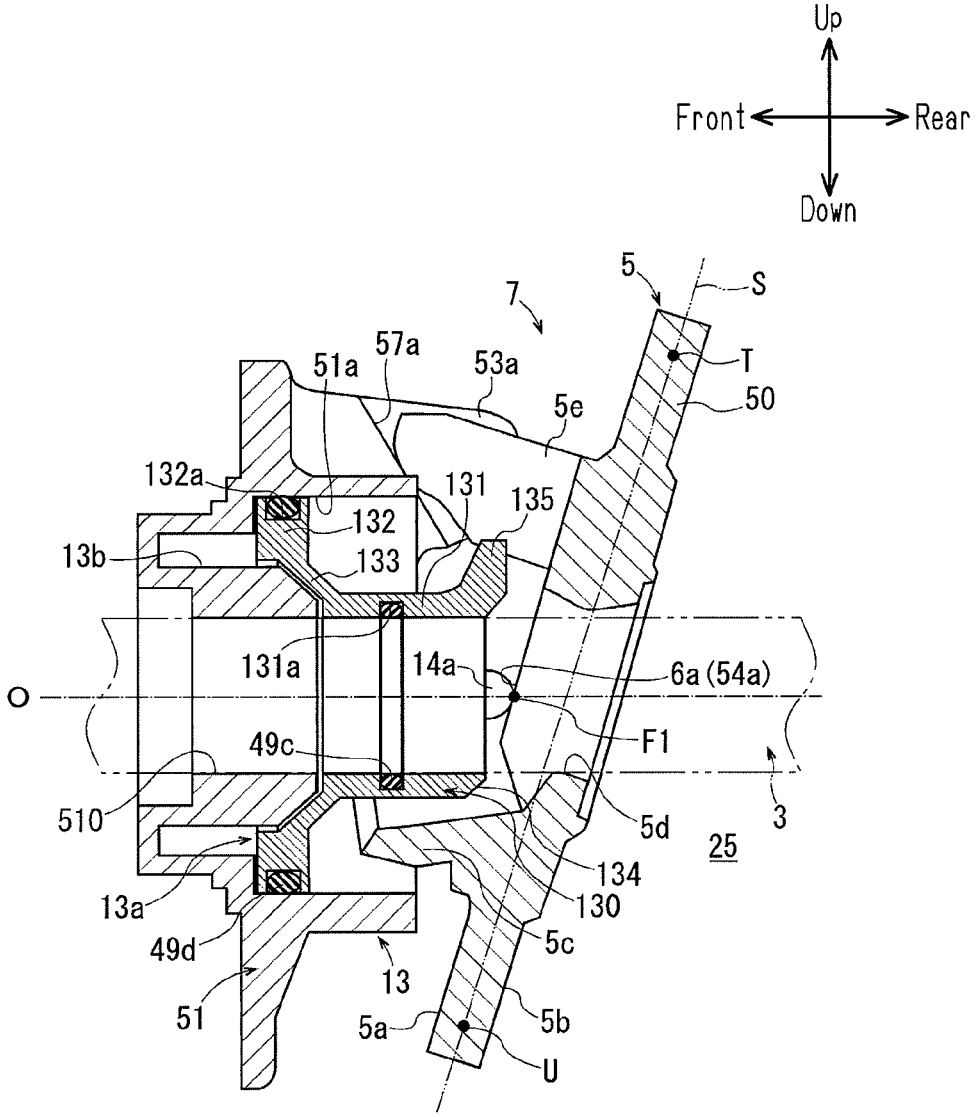
FIG. 8 is an enlarged partial cross-sectional view of the compressor according to the first embodiment in a state of the maximum displacement, in which the drive shaft and the first and second acting positions are viewed from a D1 direction in FIG. 7.

The swash plate main portion 50 is shaped as a flat annular plate and has a front surface 5*a* and a rear surface 5*b*. A top dead center associated part T for positioning each piston 9 at the top dead center and a bottom dead center associated part U for positioning each piston 9 at the bottom dead center are defined on the swash plate main portion 50. Also, as shown in FIG. 3, an imaginary top dead center plane D is defined in this compressor. The top dead center plane D includes the top dead center associated part T, the bottom dead center associated part U, and the drive shaft axis O. Further, as shown in FIG. 8, the swash plate main portion 50 includes an imaginary swash plate reference plane S for determining the inclination angle of the swash plate 5 in relation to a direction perpendicular to the drive shaft axis O. The swash plate reference plane S is parallel with the front surface 5*a* and the rear surface 5*b*.

As shown in FIG. 3, the swash plate main portion 50 includes a through hole 5*d*. The drive shaft 3 is inserted in the through hole 5*d*. Two flat guide surfaces 52*a*, 52*b* are provided in the through hole 5*d*. When the drive shaft 3 is inserted in the through hole 5*d*, the guide surfaces 52*a*, 52*b* contact the outer circumferential surface 30 of the drive shaft 3.

First and second receiving surfaces 54*a*, 54*b* are provided on the front surface of the swash plate main portion 50 about the through hole 5*d*. The first and second receiving surfaces 54*a*, 54*b* each correspond to a receiving surface. As shown in FIG. 8, the first receiving surface 54*a* is a flat surface parallel with the swash plate reference plane S. The second receiving surface 54*b*, which is shown in FIG. 3, has the same structure as the first receiving surface 54*a*. The first receiving surface 54*a* and the second receiving surface 54*b* are arranged on the front surface 5*a* at positions on opposite sides of the top dead center plane D. When the drive shaft 3 is passed through the through hole 5*d*, the drive shaft 3 is located between the first receiving surface 54*a* and the second receiving surface 54*b*.

A part of the first receiving surface 54*a* that makes line contact with a first acting portion 14*a* at a first acting position F1, which will be discussed below, is a first receiving portion 6*a*. Likewise, a part of the second receiving surface 54*b* that makes line contact with a second acting portion 14*b* at a second acting position F2, which will be discussed below, is a second receiving portion 6*b*. As described above, the first receiving surface 54*a* and the second receiving surface 54*b* are arranged on the front surface 5*a* at positions on opposite sides of the top dead center plane D. Thus, the first receiving portion 6*a* and the second receiving portion 6*b* are also located on opposite sides of the top dead center plane D. Since the first and second receiving surfaces 54*a*, 54*b* are flat, the first and second receiving portions 6*a*, 6*b* are flat.

The swash plate weight 5*c* is provided on the front surface 5*a* at a position closer to the bottom dead center associated part U than the drive shaft axis O. That is, the swash plate weight 5*c* is located between the drive shaft axis O and the bottom dead center associated part U. As shown in FIG. 1, the swash plate weight 5*c* has a substantially semi-circular cylindrical shape and extends from the front surface 5*a* toward a movable body 13*a*, which will be discussed below.

The first and second swash plate arms 5*e*, 5*f* are arranged on the front surface 5*a* at positions closer to the top dead center associated part T than the drive shaft axis O. Specifically, the first and second swash plate arms 5*e*, 5*f* are located between the drive shaft axis O and the top dead center associated part T. The first swash plate arm 5*e* and the second swash plate arm 5*f* are arranged on the front surface 5*a* at positions on opposite sides of the top dead center plane D. As shown in FIG. 1, the first and second swash plate arms 5*e*, 5*f* extend from the front surface 5*a* toward the lug plate 51. For illustrative purposes, the shapes of the swash plate weight 5*c* and the first and second swash plate arms 5*e*, 5*f* are simplified in FIG. 3. The same applies to FIGS. 10 and 14, which will be discussed below.

Figure 4:
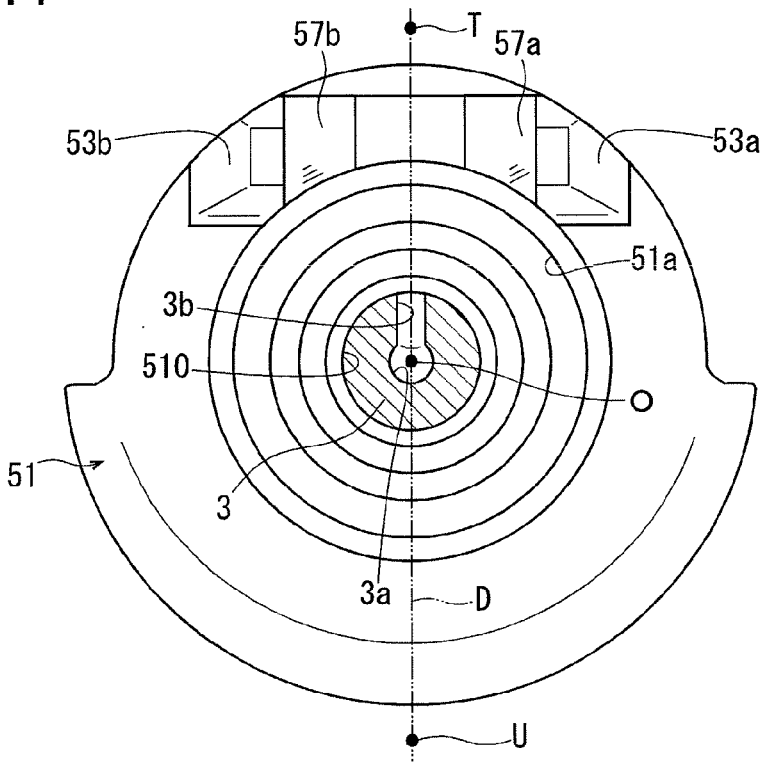
FIG. 4 is a rear view of the lug plate of the compressor according to the first embodiment.

As shown in FIG. 4, the lug plate 51 has a substantially annular shape with a through hole 510. The drive shaft 3 is press-fitted in the through hole 510, so that the lug plate 51 rotates integrally with the drive shaft 3. As shown in FIG. 1, a thrust bearing 55 is located between the lug plate 51 and the front wall 17*a*.

Figure 5:
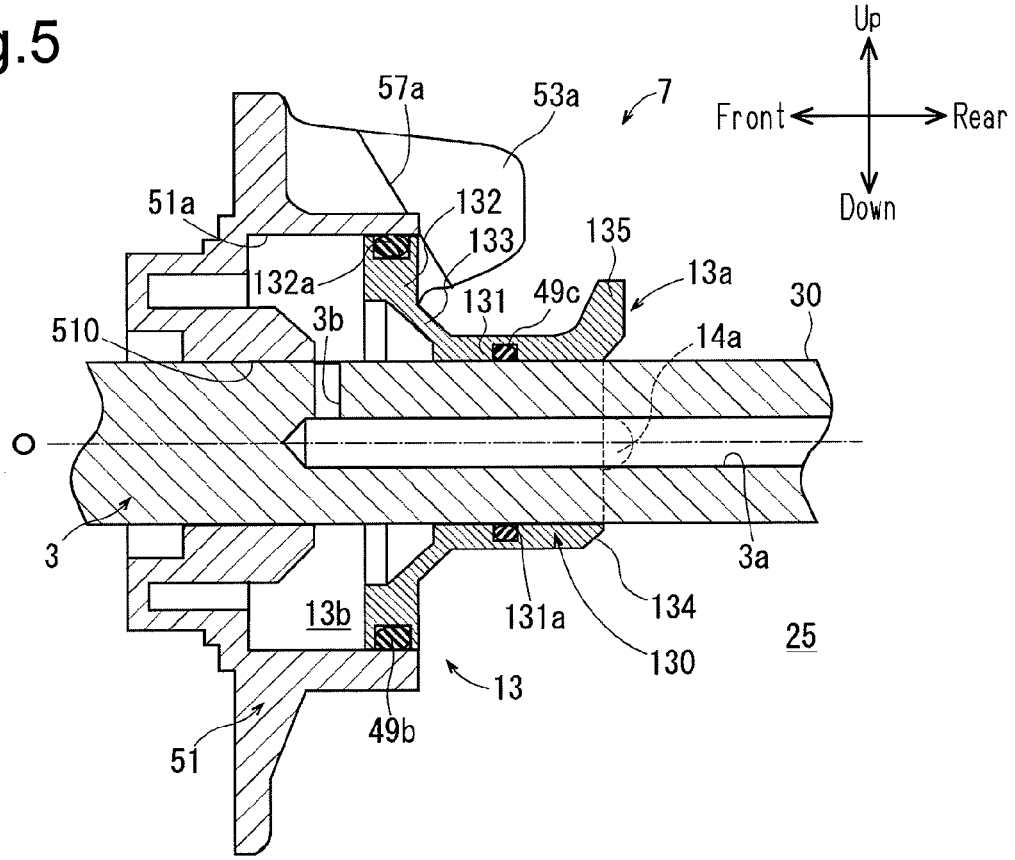
FIG. 5 is an enlarged partial cross-sectional view showing the lug plate and the movable body of the compressor according to the first embodiment.

As shown in FIG. 5, the lug plate 51 has a recessed cylinder chamber 51*a*. The cylinder chamber 51*a* has a cylindrical shape coaxial with and extending along the drive shaft axis O. The cylinder chamber 51*a* communicates with the swash plate chamber 25 at the rear.

As shown in FIG. 4, the first lug arm 53*a* and the second lug arm 53*b* are provided on the lug plate 51 at positions on opposite sides of the top dead center plane D. On the lug plate 51, the first and second lug arms 53*a*, 53*b* are located at positions closer to the top dead center associated part T on the swash plate main portion 50 than the drive shaft axis O and extend from the lug plate 51 toward the swash plate 5. That is, the first and second lug arms 53*a*, 53*b* are located between the drive shaft axis O and the top dead center associated part T on the lug plate 51.

The lug plate 51 has first and second guide surfaces 57*a*, 57*b* between the first and second lug arms 53*a*, 53*b*. The first guide surface 57*a* and the second guide surface 57*b* are also located on opposite sides of the top dead center plane D. As shown in FIG. 1, the first guide surface 57*a* is inclined such that the distance from the swash plate 5 gradually decreases from the outer circumference of the lug plate 51 toward the cylinder chamber 51*a*. The second guide surface 57*b* has the same shape as the first guide surface 57*a*.

In this compressor, the first and second swash plate arms 5*e*, 5*f* are inserted between the first and second lug arms 53*a*, 53*b* to mount the swash plate 5 to the drive shaft 3. The lug plate 51 and the swash plate 5 are thus coupled to each other with the first and second swash plate arms 5*e*, 5*f* located between the first and second lug arms 53*a*, 53*b*. When rotation of the lug plate 51 is transmitted from the first and second lug arms 53*a*, 53*b* to the first and second swash plate arms 5*e*, 5*f*, the swash plate 5 rotates with the lug plate 51 in the swash plate chamber 25.

Since the first and second swash plate arms 5*e*, 5*f* are located between the first and second lug arms 53*a*, 53*b*, the distal end of the first swash plate arm 5*e* contacts the first guide surface 57*a*, and the distal end of the second swash plate arm 5*f* contacts the second guide surface 57*b*. The first and second swash plate arms 5*e*, 5*f* slide on the first and second guide surfaces 57*a*, 57*b*, respectively. Accordingly, the swash plate 5 is allowed to change its inclination angle, which is defined by the swash plate reference plane S, between the minimum inclination angle shown in FIGS. 1 and 9 and the maximum inclination angle shown in FIG. 8, while substantially maintaining the position of the top dead center associated part T.

As shown in FIG. 5, the actuator 13 includes the lug plate 51, a movable body 13*a*, and a control pressure chamber 13*b*.

Figure 6:
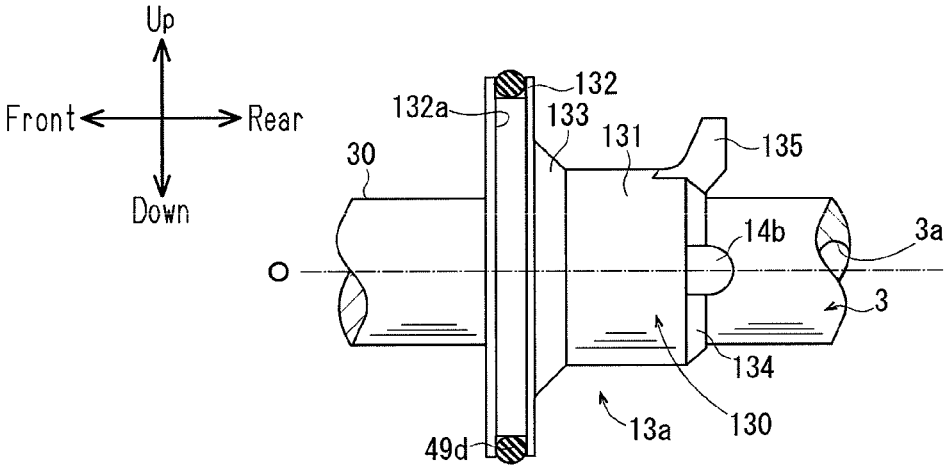
FIG. 6 is a side view of the movable body of the compressor according to the first embodiment.

As shown in FIG. 6, the movable body 13*a* is fitted about the drive shaft 3. The movable body 13*a* is thus located between the lug plate 51 and the swash plate 5 to move along the drive shaft axis O while sliding on the drive shaft 3. The movable body 13*a* has a substantially cylindrical shape coaxial with the drive shaft 3. Specifically, the movable body 13*a* has a movable body main portion 130.

The movable body main portion 130 includes a first cylindrical portion 131, a second cylindrical portion 132, and a coupling portion 133. The first cylindrical portion 131 is located at a position facing the swash plate 5 in the movable body 13*a* and extends along the drive shaft axis O. The first cylindrical portion 131 has the smallest outer diameter in the movable body main portion 130. As shown in FIG. 5, a ring groove 131*a* is provided in the inner circumferential surface of the first cylindrical portion 131. An O-ring 49*c* is fitted in the ring groove 131*a*. The second cylindrical portion 132 is located at a position on the movable body main portion 130 that faces the lug plate 51, that is, on in a front portion of the movable body 13*a*. The second cylindrical portion 132 has a diameter larger than that of the first cylindrical portion 131 and has the largest outer diameter in the movable body main portion 130. The second cylindrical portion 132 has a ring groove 132*a* in the outer circumferential surface. An O-ring 49*d* is fitted in the ring groove 132*a*. The coupling portion 133 has an outer diameter that gradually increases from the first cylindrical portion 131 toward the second cylindrical portion 132 and couples the first cylindrical portion 131 and the second cylindrical portion 132 to each other.

As shown in FIG. 6, the first cylindrical portion 131 has an acting surface 134 at the rear end, that is, at a position that faces the swash plate 5. The acting surface 134 has a shape like a truncated cone, the diameter of which decreases from the outer circumference of the first cylindrical portion 131 toward the drive shaft axis O.

Figure 7:
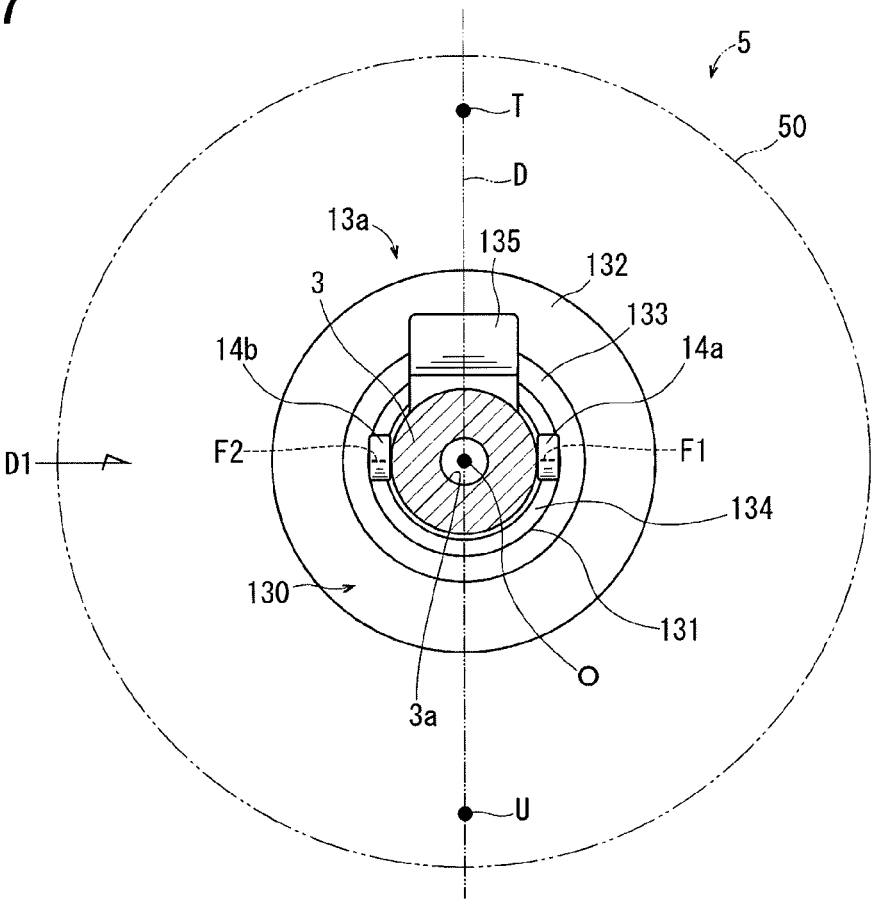
FIG. 7 is a rear view of the movable body of the compressor according to the first embodiment.

As shown in FIG. 7, the first and second acting portions 14*a*, 14*b* are provided on the acting surface 134. As shown in FIG. 8, the first acting portion 14*a* extends along the drive shaft axis O in a direction from the acting surface 134 toward the first receiving surface 54*a* the swash plate main portion 50. As in the case of the first acting portion 14*a*, the second acting portion 14*b* extends along the drive shaft axis O in a direction from the acting surface 134 toward the second receiving surface 54*b*.

As shown in FIG. 7, the first acting portion 14*a* and the second acting portion 14*b* are located on the acting surface 134 at positions on opposite sides of the top dead center plane D. Further, the first acting portion 14*a* and the second acting portion 14*b* are located on the acting surface 134 to be plane-symmetrical with respect to the top dead center plane D. Accordingly, the distance from the first acting portion 14*a* to the drive shaft axis O is equal to the distance from the second acting portion 14*b* to the drive shaft axis O. When the drive shaft 3 is passed through the movable body 13*a*, the drive shaft 3 is located between the first acting portion 14*a* and the second acting portion 14*b*.

As shown in FIG. 8, the rear end of the first acting portion 14*a* has a cylindrical shape protruding toward the swash plate 5. Thus, the first acting portion 14*a* makes line contact with a part of the first receiving surface 54*a*, that is, with the first receiving portion 6*a*, at the first acting position F1. For the illustrative purposes, the drive shaft 3 is illustrated with long dashed double-short dashed lines in FIG. 8. The same applies to FIGS. 9, 13, and 17 which will be discussed below.

Likewise, the rear end of the second acting portion 14*b* has a cylindrical shape protruding toward the swash plate 5. Thus, the second acting portion 14*b* makes line contact with a part of the second receiving surface 54*b*, that is, with the second receiving portion 6*b*, at the second acting position F2. Accordingly, the acting surface 134 contacts the first and second receiving surfaces 54*a*, 54*b* via the first and second acting portions 14*a*, 14*b* and the first and second receiving portions 6*a*, 6*b*.

As described above, the first and second acting portions 14*a*, 14*b* are located on the acting surface 134 at positions on opposite sides of the top dead center plane D, the first and second receiving surfaces 54*a*, 54*b* are arranged on the front surface of the swash plate main portion 50 at positions on opposite sides of the top dead center plane D. Thus, as shown in FIG. 7, the first acting position F1 and the second acting position F2 are located at positions on opposite sides of the top dead center plane D.

Figure 9:
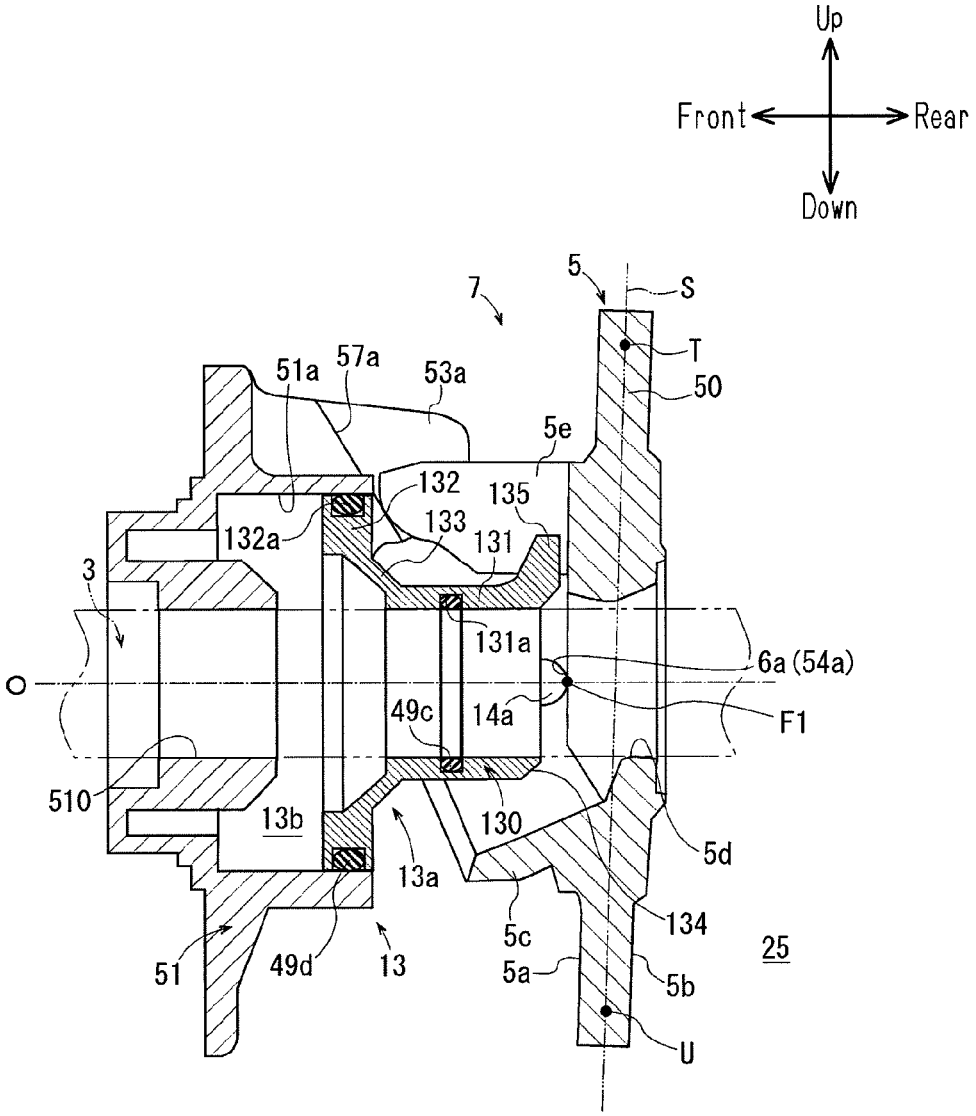
FIG. 9 is an enlarged partial cross-sectional view of the compressor according to the first embodiment in a state of the minimum displacement, in which the drive shaft and the first and second acting positions are viewed from a D1 direction in FIG. 7.

When the drive shaft 3 and the first and second acting positions F1, F2 are viewed from a D1 direction, which is perpendicular to the top dead center plane D, as indicated by the arrow in FIG. 7, the first acting position F1 is defined at a position overlapping with the drive shaft axis O as shown in FIGS. 8 and 9 regardless of the inclination angle of the swash plate 5. As in the case of the first acting position F1, the second acting position F2, which is shown in FIG. 1, is defined at a position overlapping with the drive shaft axis O regardless of the inclination angle of the swash plate 5. That is, when the drive shaft 3 and the first and second acting positions F1, F2 are viewed from the D1 direction of FIG. 7, the first and second acting portions 14*a*, 14*b* are each located on the acting surface 134 to overlap with the drive shaft axis O regardless of the inclination angle of the swash plate 5.

As shown in FIG. 6, the first cylindrical portion 131 has a rotation stopper 135, which restricts the movable body 13*a* from rotating about the drive shaft axis O. The rotation stopper 135 has a rectangular shape as shown in FIG. 7 and extends from the outer circumferential surface of the first cylindrical portion 131 toward the top dead center associated part T of the swash plate main portion 50. The rotation stopper 135 is located between the movable body main portion 130 and the swash plate main portion 50, more specifically, between the first swash plate arm 5*e* and the second swash plate arm 5*f*, which are shown in FIG. 3. Thus, as the swash plate 5 rotates, the rotation stopper 135 contacts the first swash plate arm 5*e* or the second swash plate arm 5*f* to restrict the movable body 13*a* from rotating about the drive shaft axis O. This allows the movable body 13*a* to be rotated integrally with the lug plate 51 and the swash plate 5 by rotation of the drive shaft 3.

As shown in FIG. 5, the control pressure chamber 13*b* is defined by the second cylindrical portion 132, the coupling portion 133, the cylinder chamber 51*a*, and the drive shaft 3. The control pressure chamber 13*b* and the swash plate chamber 25 are sealed off from each other by the O-rings 49*c*, 49*d*.

The drive shaft 3 has an axial passage 3*a* and a radial passage 3*b*. The axial passage 3*a* extends from the rear end of the drive shaft 3 toward the front end along the drive shaft axis O. The radial passage 3*b* extends in a radial direction from the front end of the axial passage 3*a* and opens in the outer circumferential surface of the drive shaft 3. As shown in FIG. 1, the rear end of the axial passage 3*a* communicates with the pressure regulation chamber 31. The radial passage 3*b* communicates with control pressure chamber 13*b* as shown in FIG. 5. The axial passage 3*a* and the radial passage 3*b* connect the pressure regulation chamber 31 to the control pressure chamber 13*b*.

As shown in FIG. 1, the drive shaft 3 has, at the front end, a threaded portion 3*c*. The drive shaft 3 is connected to a non-illustrated pulley or a non-illustrated electromagnetic clutch through the threaded portion 3*c*.

Each piston 9 is accommodated in the corresponding one of the cylinder bores 21*a* and is allowed to reciprocate in the cylinder bore 21*a*. Each piston 9 and the valve assembly plate 23 define a compression chamber 57 in the corresponding cylinder bore 21*a*.

Each piston 9 has an engaging portion 9*a*. Each engaging portion 9*a* accommodates a pair of hemispherical shoes 11*a*, 11*b*. The shoes 11*a*, 11*b* correspond to a conversion mechanism. Each shoe 11*a* slides on the front surface 5*a* of the swash plate main portion 50. In contrast, each shoe 11*b* slides on the rear surface 5*b* of the swash plate main portion 50. The swash plate main portion 50 thus actuates the shoes 11*a*, 11*b*. Accordingly, the shoes 11*a*, 11*b* convert rotation of the swash plate 5 into reciprocation of the pistons 9, and the pistons 9 reciprocate in the cylinder bores 21*a* by a stroke corresponding to the inclination angle defied by the swash plate reference plane S. Instead of providing the shoes 11*a*, 11*b*, a wobble plate type conversion mechanism may be employed in which a wobble plate is provided on the rear surface 5*b* of the swash plate main portion 50 via a thrust bearing, and the wobble plate and the pistons 9 are connected to each other with connecting rods.

As shown in FIG. 2, the control mechanism 15 includes a low-pressure passage 15*a*, a high-pressure passage 15*b*, a control valve 15*c*, an orifice 15*d*, the axial passage 3*a*, and the radial passage 3*b*.

The low-pressure passage 15*a* is connected to the pressure regulation chamber 31 and the suction chamber 33. The low-pressure passage 15*a*, the axial passage 3*a*, and the radial passage 3*b* connect the control pressure chamber 13*b*, the pressure regulation chamber 31, and the suction chamber 33 to one another. The high-pressure passage 15*b* is connected to the pressure regulation chamber 31 and the discharge chamber 35. The high-pressure passage 15*b*, the axial passage 3*a*, and the radial passage 3*b* connect the control pressure chamber 13*b*, the pressure regulation chamber 31, and the discharge chamber 35 to one another.

The control valve 15*c* is arranged in the low-pressure passage 15*a*. The low-pressure control valve 15*c* is allowed to adjust the opening degree of the low-pressure passage 15*a* based on the pressure in the suction chamber 33. The high-pressure passage 15*b* also has the orifice 15*d*.

In this compressor, a pipe connected to the evaporator is connected to the inlet 250 shown in FIG. 1, and a pipe connected to the condenser is connected to the outlet. The condenser is connected to the evaporator via a pipe and an expansion valve. These components, which include the compressor, the evaporator, the expansion valve, and the condenser, constitute the refrigeration circuit in the air conditioner for a vehicle. The illustration of the evaporator, the expansion valve, the condenser, and the pipes is omitted.

In the compressor having the above-described configuration, the drive shaft 3 rotates to rotate the swash plate 5, thus reciprocating each piston 9 in the corresponding cylinder bore 21*a*. This varies the volume of each compression chamber 57 in accordance with the piston stroke. Thus, the refrigerant that has been drawn from the evaporator into the swash plate chamber 25 through the inlet 250 flows through the suction passage 39 and the suction chamber 33 and is compressed in the compression chambers 57. The refrigerant that is compressed in the compression chambers 57 is discharged to the discharge chamber 35 and is discharged to the condenser through the outlet.

The actuator 13 changes the inclination angle of the swash plate 5 to increase or decrease the stroke of the pistons 9, thereby varying the displacement of the compressor.

Specifically, when the control valve 15*c* of the control mechanism 15 shown in FIG. 2 reduces the opening degree of the low-pressure passage 15*a*, the pressure in the pressure regulation chamber 31 is increased, and the pressure in the control pressure chamber 13*b* is increased. This causes the movable body 13*a* to move along the drive shaft axis O toward the swash plate 5 as shown in FIG. 9, while moving away from the lug plate 51.

Accordingly, at the first acting position F1, the first acting portion 14*a* pushes the first receiving portion 6*a* along the drive shaft axis O toward the rear of the swash plate chamber 25. Likewise, at the second acting position F2, the second acting portion 14*b* pushes the second receiving portion 6*b* along the drive shaft axis O toward the rear of the swash plate chamber 25. Therefore, the first and second swash plate arms 5*e*, 5*f* slide on the first and second guide surfaces 57*a*, 57*b*, respectively, toward the drive shaft axis O.

Thus, the swash plate 5 decreases the inclination angle while substantially maintaining the position of the top dead center associated part T. This reduces the stroke of the pistons 9 and the displacement of the compressor per rotation of the drive shaft 3. When reaching the minimum inclination angle shown in the drawing, the swash plate 5 contacts the restoration spring 37.

In contrast, when the control valve 15*c* of the control mechanism 15 shown in FIG. 2 increases the opening degree of the low-pressure passage 15*a*, the pressure in the pressure regulation chamber 31 and thus the pressure in the control pressure chamber 13*b* become substantially equal to the pressure in the suction chamber 33. Thus, reaction force that acts on the swash plate 5 from components such as the pistons 9 causes the movable body 13*a* to move along the drive shaft axis O from the swash plate 5 toward the lug plate 51 as shown in FIG. 8.

The reaction force acting on the swash plate 5 and the urging force of the restoration spring 37 cause the first and second swash plate arms 5*e*, 5*f* to slide on the first and second guide surfaces 57*a*, 57*b*, respectively, to move away from the drive shaft axis O.

Accordingly, the swash plate 5 thus increases the inclination angle while substantially maintaining the position of the top dead center associated part T. This increases the stroke of the pistons 9 and thus increases the displacement of the compressor per rotation of the drive shaft 3. When the inclination angle of the swash plate 5 is maximized in the drawing, the displacement per rotation of the drive shaft 3 is maximized.

As described above, a part of the first receiving surface 54*a* on the front surface 5*a* of the swash plate main portion 50 serves as the first receiving portion 6*a*. The first receiving portion 6*a* is pushed while making line contact with the first acting portion 14*a* provided on the movable body 13*a* at the first acting position F1. Likewise, a part of the second receiving surface 54*b* on the front surface 5*a* serves as the second receiving portion 6*b*. The second receiving portion 6*b* is pushed while making line contact with the second acting portion 14*b* provided on the movable body 13*a* at the second acting position F2. Accordingly, the inclination angle of the swash plate 5 is reduced. That is, when reducing the inclination angle of the swash plate 5, the movable body 13*a* pushes the swash plate 5 along the drive shaft axis O, while making line contact with the swash plate 5 via the first and second acting positions F1, F2. Since the compressor has no sleeve such as a conventional hinge ball between the movable body 13*a* and the swash plate 5, the size of the compressor is reduced, accordingly. Thus, it is possible to increase the size of the movable body 13*a* so that the movable body 13*a* is moved by a greater thrust without increasing the overall size of the compressor.

Since the movable body 13*a* pushes the swash plate 5 while directly contacting the swash plate 5, the direction of the load acting on the swash plate 5 resists change. That is, the movable body 13*a* is not easily inclined in any direction other than the direction in which the drive shaft axis O extends, and resists warping. Therefore, the movable body 13*a* is reliably allowed to push the swash plate 5 along the drive shaft axis O, so that the movable body 13*a* stably reduces the inclination angle of the swash plate 5. Since the orientation of the movable body 13*a* is stabilized, pressure leakage in the control pressure chamber 13*b* is unlikely to occur.

Then, with reference to the top dead center plane D, the first acting portion 14*a* pushes the first receiving portion 6*a* at the first acting position F1, and the second acting portion 14*b* pushes the second receiving portion 6*b* at the second acting position F2. Accordingly, when the inclination angle of the swash plate 5 is reduced, the movable body 13*a* pushes the swash plate 5 at two positions, or the first acting position F1 and the second acting position F2, which are on opposite sides of the top dead center plane D.

Particularly, when the drive shaft 3 and the first and second acting positions F1, F2 are viewed from the D1 direction, which is perpendicular to the top dead center plane D, the first and second acting positions F1, F2 overlap with the drive shaft axis O as shown in FIGS. 8 and 9 regardless of the inclination angle of the swash plate 5. Thus, when the inclination angle of the swash plate 5 is reduced, the first and second acting portions 14*a*, 14*b* are allowed to push the first and second receiving portions 6*a*, 6*b* at positions close to the drive shaft axis O, respectively.

Therefore, even if the movable body 13*a* pushes the swash plate 5 via the first and second acting positions F1, F2, the swash plate 5 is not easily inclined in a direction other than the direction in which the inclination angle is changed and thus resists warping. Thus, when the inclination angle of the swash plate 5 is changed, the movable body 13*a* is allowed to smoothly move along the drive shaft axis O.

Therefore, the compressor according to the first embodiment achieves a sufficient controllability, while minimizing the size.

Further, the reaction force that acts from the pistons 9 to the swash plate 5 during operation of the compressor generates moment that acts to rotate the swash plate 5 in a direction other than the direction in which the inclination angle is changed. In this respect, the guide surfaces 52*a*, 52*b* in the through hole 5*d* of the compressor slide on the outer circumferential surface 30 of the drive shaft 3 in response to changes in the inclination angle of the swash plate 5. Then, the swash plate 5 is guided by the link mechanism 7 and the drive shaft 3 along the drive shaft axis O and in the direction of the inclination angle, so that the inclination angle is changed as described above. At this time, the guide surfaces 52*a*, 52*b* allow the swash plate 5 to easily contact the outer circumferential surface 30 of the drive shaft 3 at two points on opposite sides of the drive shaft axis O. Therefore, the compressor reliably prevents the swash plate 5 from being warped by the moment. Since the compressor has no sleeve, the number of components is reduced, and the manufacturing costs are reduced, accordingly.

The first and second acting portions 14*a*, 14*b* are provided on the acting surface 134, and the first and second acting portions 14*a*, 14*b* protrude toward the first and second receiving surfaces 54*a*, 54*b*, respectively. This allows the first and second receiving surfaces 54*a*, 54*b*, and thus the first and second receiving portions 6*a*, 6*b*, to be flat and parallel with the swash plate reference plane S, facilitating the production of the swash plate 5. In this respect also, the production costs for the compressor are reduced.

Further, the rotation stopper 135 restricts the movable body 13*a* from rotating about the drive shaft axis O. Thus, when the inclination angle of the swash plate 5 is reduced, the first and second acting portions 14*a*, 14*b* are prevented from pushing the first and second receiving portions 6*a*, 6*b* at positions offset from positions overlapping with the drive shaft axis O, respectively.

Second Embodiment

Figure 10:
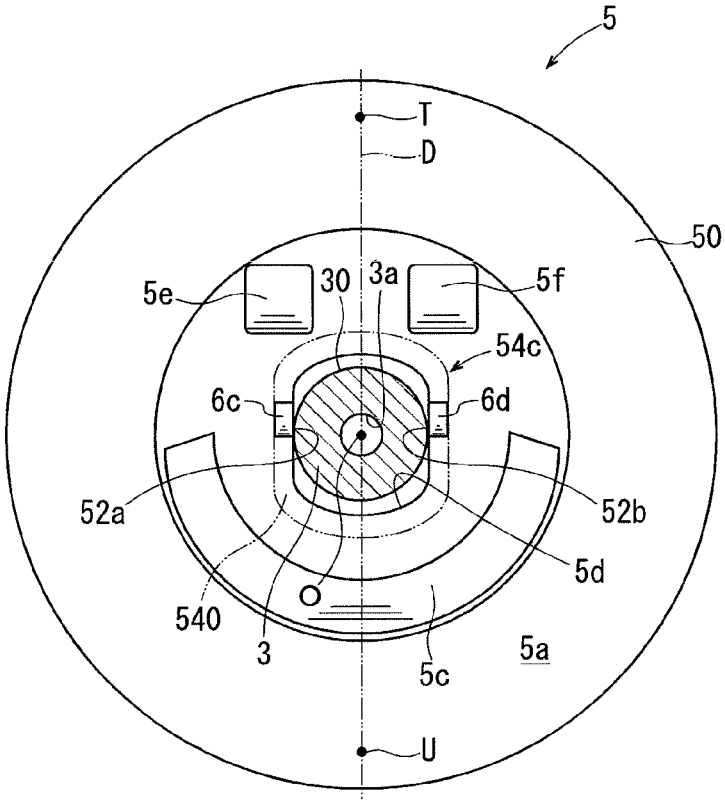
FIG. 10 is a schematic front view of the swash plate of a compressor according to a second embodiment.
Figure 13:
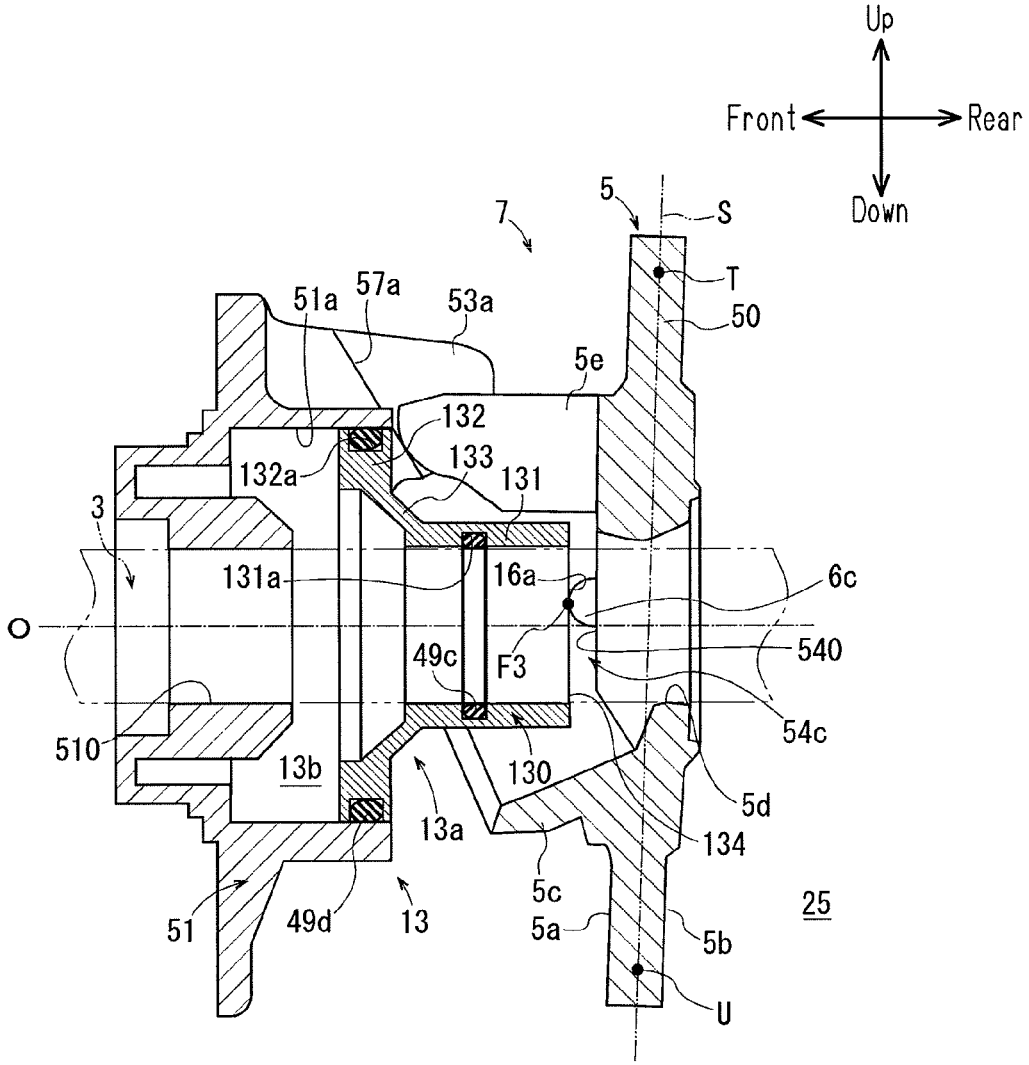
FIG. 13 is an enlarged partial cross-sectional view of the compressor according to the second embodiment in a state of the minimum displacement, in which the drive shaft and the first and second acting positions are viewed from a D1 direction in FIG. 12.

In the compressor according to the second embodiment, the first and second receiving surfaces 54*a*, 54*b* of the compressor according to the first embodiment are replaced by a receiving surface 54*c* as shown in FIG. 10. The receiving surface 54*c* is also arranged on the front surface 5*a* of the swash plate main portion 50 and about the through hole 5*d*. The receiving surface 54*c* has a flat section 540 and first and second protrusions 6*c*, 6*d*. As shown in FIG. 13, the flat section 540 is a flat surface parallel with the swash plate reference plane S.

The first protrusion 6*c* extends along the drive shaft axis O and in a direction from the flat section 540 toward the movable body main portion 130. The distal end of the first protrusion 6*c*, that is, the part that faces the movable body main portion 130, has a cylindrical shape protruding toward the movable body 13*a*. The second protrusion 6*d*, which is shown in FIG. 10, has the same structure as the first protrusion surface 6*c*. The first and second protrusions 6*c*, 6*d* correspond to first and second receiving portions.

Figure 12:
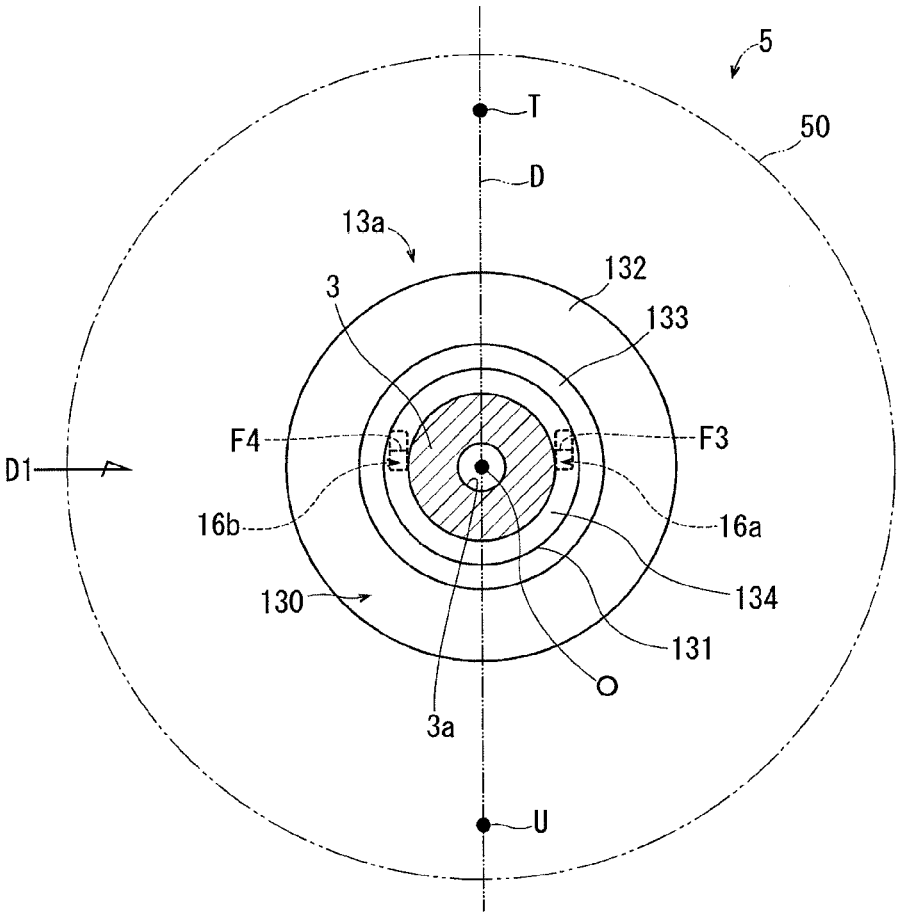
FIG. 12 is a rear view of the movable body of the compressor according to the second embodiment.

As shown in FIG. 12, the first protrusion 6*c* and the second protrusion 6*d* are provided on the flat section 540 at positions on opposite sides of the top dead center plane D. Further, the first protrusion 6*c* and the second protrusion 6*d* are located on the flat section 540 to be plane-symmetrical with respect to the top dead center plane D. When the drive shaft 3 is passed through the through hole 5*d*, the drive shaft 3 is located between the first protrusion 6*c* and the second protrusion 6*d*. Further, the first protrusion 6*c* and the second protrusion 6*d* are located at positions slightly closer to the top dead center associated part T than the drive shaft axis O.

Figure 11:
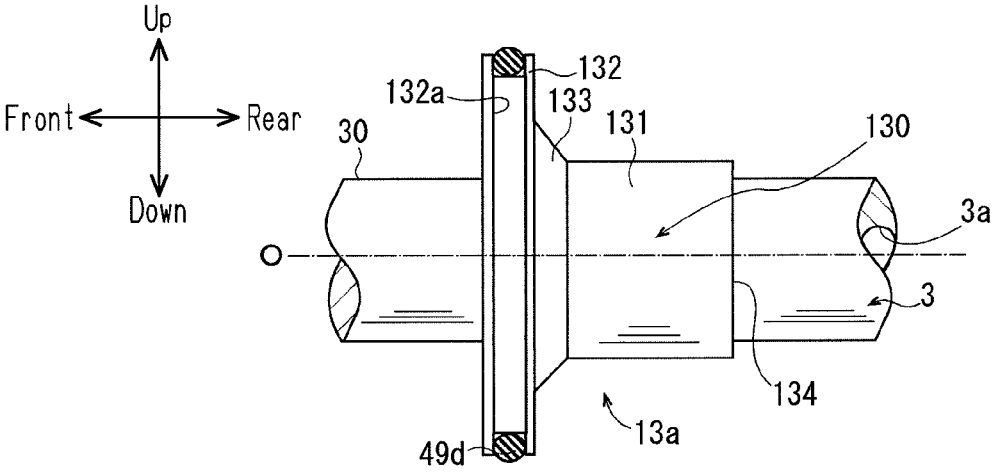
FIG. 11 is a side view of the movable body of the compressor according to the second embodiment.

Also, as shown in FIG. 11, the acting surface 134 of the movable body 13*a* is a flat surface perpendicular to the drive shaft axis O. As shown in FIG. 12, a part of the acting surface 134 that makes line contact with the first protrusion 6*c* at the first acting position F3 serves as a first acting portion 16*a*. A part of the acting surface 134 that makes line contact with the second protrusion 6*d* at the second acting position F4 serves as a second acting portion 16*b*.

When the drive shaft 3 and the first and second acting positions F3, F4 are viewed from the D1 direction in FIG. 12, the first acting position F3 overlaps with the drive shaft 3 and is located at a position slightly closer to the top dead center associated part T than the drive shaft axis O as shown in FIG. 13 regardless of the inclination angle of the swash plate 5. The second acting position F4, which is shown in FIG. 12, has the same structure as the first acting position F3.

The movable body 13*a* of this compressor does not have the rotation stopper 135 in the first cylindrical portion 131. Thus, as shown in FIG. 13, the cross-sectional shape of the movable body 13*a* along a given plane containing the drive shaft axis O is line-symmetric with respect to the drive shaft axis O. The other components of the compressor of the second embodiment are configured identically with the corresponding components of the compressor of the first embodiment. Accordingly, these components are identified by the same reference numbers, and detailed description thereof is omitted herein.

In this compressor also, when the inclination angle of the swash plate 5 is reduced, the first acting portion 16*a* pushes the first protrusion 6*c* toward the rear of the swash plate chamber 25 at the first acting position F3. Also, at the second acting position F4, the second acting portion 16*b* pushes the second protrusion 6*d* along the drive shaft axis O toward the rear of the swash plate chamber 25.

When the drive shaft 3 and the first and second acting positions F3, F4 are viewed from the D1 direction, which is perpendicular to the top dead center plane D, the first and second acting positions F3, F4 overlap with the drive shaft 3 and are located at positions slightly closer to the top dead center associated part T than the drive shaft axis O regardless of the inclination angle of the swash plate 5. Thus, when the inclination angle of the swash plate 5 is reduced, the first and second acting portions 16*a*, 16*b* are allowed to push the first and second protrusions 6*c*, 6*d* at positions close to the drive shaft axis O, respectively. Therefore, even if the movable body 13*a* pushes the swash plate 5 via the first and second acting positions F3, F4, the swash plate 5 is not easily inclined in a direction other than the direction in which the inclination angle is changed and thus resists warping. Thus, when the inclination angle of the swash plate 5 is changed, the movable body 13*a* is allowed to smoothly move along the drive shaft axis O.

The first and second acting positions F3, F4 are respectively defined at positions slightly closer to the top dead center associated part T than the drive shaft axis O. Thus, compared to the compressor according to the first embodiment, the stroke of the movable body 13*a* along the drive shaft axis O is reduced when the inclination angle of the swash plate 5 is changed in the present embodiment.

Further, in this compressor, parts of the acting surface 134 serve as the first acting portion 16*a* and the second acting portion 16*b*. The movable body 13*a* is permitted to rotate about the drive shaft axis O to some extent, so that there is no need to provide a member such as the rotation stopper 135 for restricting the movable body 13*a* from rotating about the drive shaft axis O. This allows the cross-sectional shape of the movable body 13*a* along a given plane containing the drive shaft axis O to be line-symmetric with respect to the drive shaft axis O, thereby facilitating the production of the movable body 13*a*. Thus, the production costs for the compressor are reduced.

In this compressor, as described above, a part of the acting surface 134 makes line contact with the first protrusion 6*c* at the first acting position F3 and another part of the acting surface 134 makes line contact with the second protrusion 6*d* at the second acting position F4 without restricting the movable body 13*a* from rotating about the drive shaft axis O by the rotation stopper 135 as in the compressor of the first embodiment. Therefore, when the inclination angle of the swash plate 5 is reduced, the first and second acting positions F3, F4 are not displaced from positions overlapping with the drive shaft 3 and slightly closer to the top dead center associated part T than the drive shaft axis O regardless of the inclination angle of the swash plate 5. The other operations of the compressor are the same as the corresponding operations of the compressor of the first embodiment.

Third Embodiment

Figure 14:
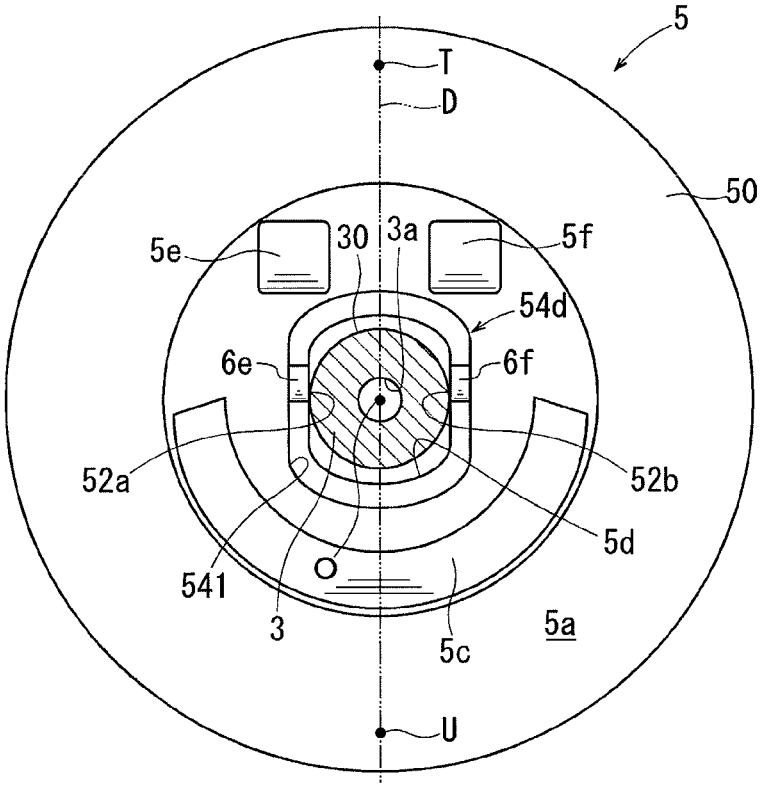
FIG. 14 is a schematic front view of the swash plate of a compressor according to a third embodiment.
Figure 17:
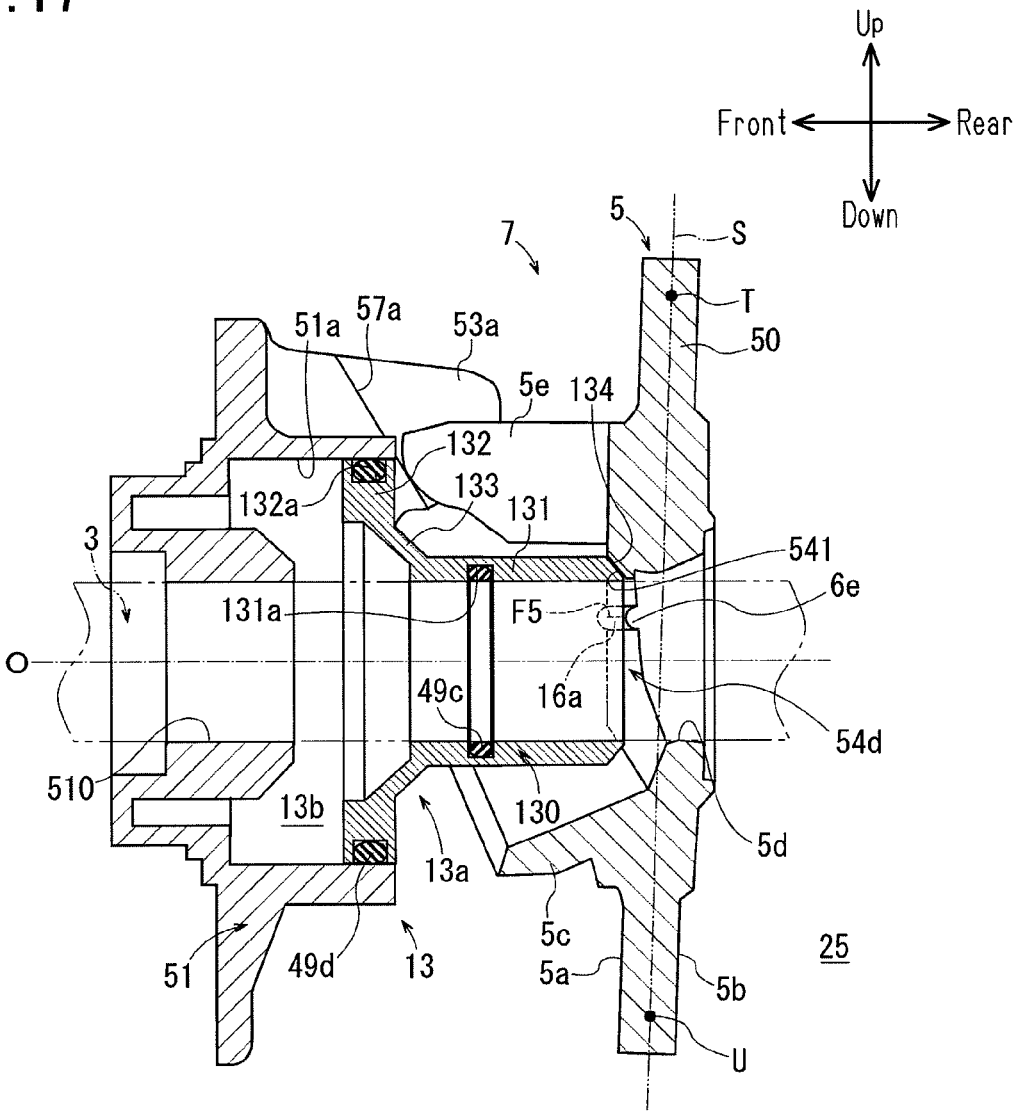
FIG. 17 is an enlarged partial cross-sectional view of the compressor according to the third embodiment in a state of the minimum displacement, in which the drive shaft and the first and second acting positions are viewed from a D1 direction in FIG. 16.

The compressor of the third embodiment has a receiving surface 54*d* as shown in FIG. 14. The receiving surface 54*d* is also arranged on the front surface 5*a* of the swash plate main portion 50 and about the through hole 5*d*. The receiving surface 54*d* has a mortar portion 541 and first and second protrusions 6*e*, 6*f*. As shown in FIG. 17, the mortar portion 541 has a decreasing diameter along the drive shaft axis O to conform to the acting surface 134 regardless of the inclination angle of the swash plate 5.

The first protrusion 6*e* extends in a direction from the mortar portion 541 toward the movable body main portion 130. The distal end of the first protrusion 6*e* has a cylindrical shape protruding toward the movable body 13*a*. The second protrusion 6*f*, which is shown in FIG. 14, has the same structure as the first protrusion 6*e*. The first and second protrusions 6*e*, 6*f* correspond to first and second receiving portions, respectively.

The first protrusion 6*e* and the second protrusion 6*f* are located on the mortar portion 541 at positions on opposite sides of the top dead center plane D. Further, the first protrusion 6*e* and the second protrusion 6*f* are located on the mortar portion 541 to be plane-symmetrical with respect to the top dead center plane D. When the drive shaft 3 is passed through the through hole 5*d*, the drive shaft 3 is located between the first protrusion 6*e* and the second protrusion 6*f*. Further, the first protrusion 6*e* and the second protrusion 6*f* are located at positions slightly closer to the top dead center associated part T than the drive shaft axis O.

Figure 15:
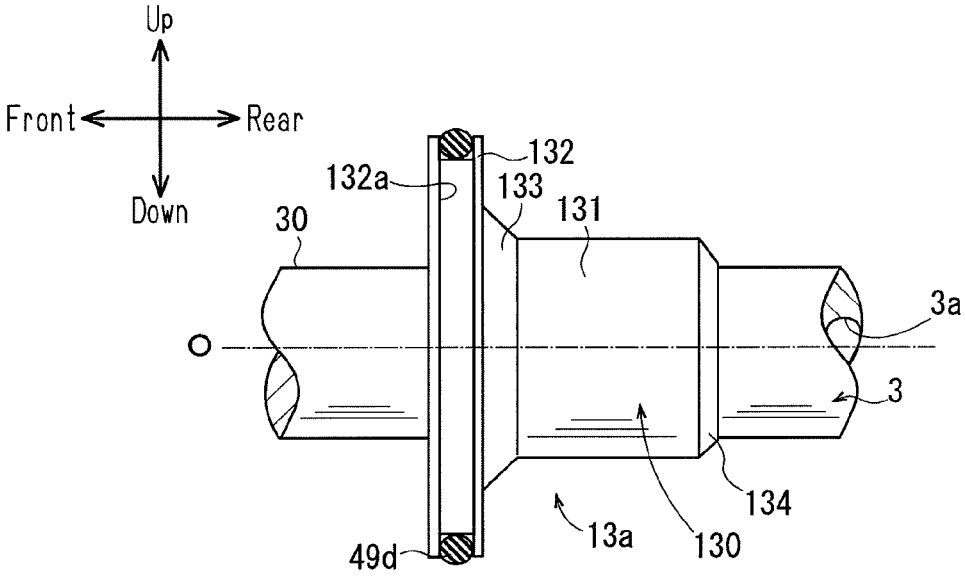
FIG. 15 is a side view of the movable body of the compressor according to the third embodiment.
Figure 16:
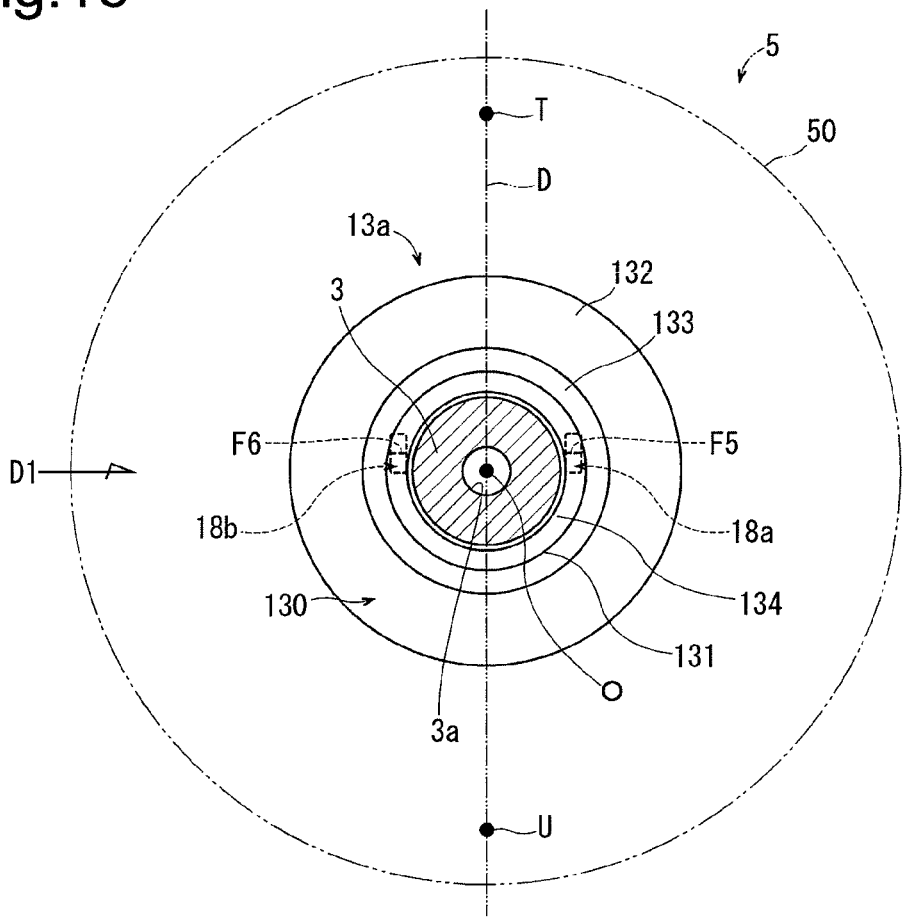
FIG. 16 is a rear view of the movable body of the compressor according to the third embodiment.

Also, as shown in FIG. 15, the acting surface 134 of the movable body 13*a* has a truncated conical shape with a diameter decreasing from the outer circumference of the first cylindrical portion 131 toward the drive shaft axis O. As shown in FIG. 16, a part of the acting surface 134 that makes line contact with the first protrusion 6*e* at the first acting position F5 serves as a first acting portion 18*a*. A part of the acting surface 134 that makes line contact with the second protrusion 6*f* at the second acting position F6 serves as a second acting portion 18*b*.

As in the case of the compressor of the second embodiment, when the drive shaft 3 and the first and second acting positions F5, F6 are viewed from the D1 direction in FIG. 16, the first acting position F5 overlaps with the drive shaft 3 and is located at a position slightly closer to the top dead center associated part T than the drive shaft axis O as shown in FIG. 17 regardless of the inclination angle of the swash plate 5. The second acting position F6, which is shown in FIG. 16, has the same structure as the first acting position F5.

The movable body 13*a* of this compressor also does not have the rotation stopper 135 in the first cylindrical portion 131. Thus, as shown in FIG. 17, the cross-sectional shape of the movable body 13*a* along a given plane containing the drive shaft axis O is line-symmetric with respect to the drive shaft axis O. The other structures of the compressor are the same as the corresponding structures of the compressor of the first embodiment.

In this compressor, when the inclination angle of the swash plate 5 is reduced, the first and second acting portions 18*a*, 18*b* push the first and second protrusions 6*e*, 6*f* toward the rear of the swash plate chamber 25 at the first and second acting positions F5, F6, respectively.

When the drive shaft 3 and the first and second acting positions F5, F6 are viewed from the D1 direction, which is perpendicular to the top dead center plane D, the first and second acting positions F5, F6 overlap with the drive shaft 3 and are located at positions slightly closer to the top dead center associated part T than the drive shaft axis O regardless of the inclination angle of the swash plate 5. Thus, when the inclination angle of the swash plate 5 is reduced, the first and second acting portions 18*a*, 18*b* are allowed to push the first and second protrusions 6*c*, 6*d* at positions close to the drive shaft axis O, respectively. Thus, as in the compressor according to the second embodiment, the stroke of the movable body 13*a* along the drive shaft axis O is reduced when the inclination angle of the swash plate 5 is changed in the present embodiment.

Further, the acting surface 134 has a shape like a truncated cone, the diameter of which decreases from the outer circumference of the first cylindrical portion 131 toward the drive shaft axis O. The mortar portion 541 has a shape that conforms to the acting surface 134 regardless of the inclination angle. Thus, in this compressor, the swash plate 5 changes the inclination angle while being aligned with the movable body 13*a*. Therefore, when the inclination angle of the swash plate 5 is changed, no vibrations are generated in the swash plate 5. This allows the inclination angle to be reliably changed.

Also, parts of the acting surface 134 serve as the first acting portion 18*a* and the second acting portion 18*b*, and there is no need to provide a member such as the rotation stopper 135 for restricting the movable body 13*a* from rotating about the drive shaft axis O. This allows the cross-sectional shape of the movable body 13*a* along a given plane containing the drive shaft axis O to be line-symmetric with respect to the drive shaft axis O, thereby facilitating the production of the movable body 13*a*.

In this compressor also, a part of the acting surface 134 makes line contact with the first protrusion 6*e* at the first acting position F5 and another part of the acting surface 134 makes line contact with the second protrusion 6*f* at the second acting position F6 without restricting the movable body 13*a* from rotating about the drive shaft axis O by the rotation stopper 135 as in the compressor of the second embodiment. Therefore, when the inclination angle of the swash plate 5 is reduced, the first and second acting positions F5, F6 are not displaced from positions overlapping with the drive shaft 3 and slightly closer to the top dead center associated part T than the drive shaft axis O regardless of the inclination angle of the swash plate 5. The other operations of the compressor are the same as the corresponding operations of the compressor of the first embodiment.

Although only the first to third embodiments of the present invention have been described so far, the present invention is not limited to the first to third embodiments, but may be modified as necessary without departing from the scope of the invention.

For example, when the drive shaft 3 and the first and second acting positions F1, F2 are viewed from the D1 direction in the compressor of the first embodiment, the first and second acting positions F1, F2 may be located at any positions regardless of the inclination angle of the swash plate 5 as long as these positions overlap with the drive shaft 3. For example, the first and second acting positions F1, F2 may be located at positions slightly closer to the top dead center associated part T than the drive shaft axis O or positions closer to the bottom dead center associated part U.

The modification may be applied to the compressors of the first and second embodiments.

In the compressor according to the first embodiment, the first and second acting portions 14*a*, 14*b* and the first and second receiving portions 6*a*, 6*b* may be configured to make point contact with each other at the first and second acting positions F1, F2, respectively. The same modification may be applied to the first and second protrusions 6*c* to 6*f* of the compressor according to the first and second embodiments.

Further, the compressor according to the first embodiment may be configured such that only one of the first acting portion 14*a* and the second acting portion 14*b* is provided on the acting surface 134, and one of the first receiving surface 54*a* and the second receiving surface 54*b*, which correspond to the first acting portion 14*a* or the second acting portion 14*b*, may be provided on the front surface 5*a* of the swash plate main portion 50. Likewise, in the compressors according to the second and third embodiments, the first protrusions 6*c*, 6*e* or the second protrusions 6*d*, 6*f* may be provided on the flat section 540 or the mortar portion 541.

In the compressor according to the third embodiment, the receiving surface 54*d* may be configured without the first and second protrusions 6*e*, 6*f*.

The compressor according to the first embodiment may be configured such that the inclination angle of the swash plate 5 is increased when the first and second acting portions 14*a*, 14*b* push the first and second receiving portions 6*a*, 6*b* along the drive shaft axis O, respectively. The same modification may be applied to the compressors of the second and third embodiments.

Further, regarding the control mechanism 15 of the compressor according to the first to third embodiments, the control valve 15*c* may be provided in the high-pressure passage 15*b*, and the orifice 15*d* may be provided in the low-pressure passage 15*a*. In this case, the control valve 15*c* is allowed to adjust the flow rate of high-pressure refrigerant flowing through the high-pressure passage 15*b*. This allows the high-pressure in the discharge chamber 35 to promptly increase the pressure in the control pressure chamber 13*b* and to promptly reduce the displacement. Also, the control valve 15*c* may be replaced by a three-way valve connected to the low-pressure passage 15*a* and the high-pressure passage 15*b*. In this case, the opening degree of the three-way valve is adjusted to regulate the flow rate of refrigerant flowing through the low-pressure passage 15*a* and the high-pressure passage 15*b*.

Therefore, the present examples and embodiments are to be considered as illustrative and not restrictive and the invention is not to be limited to the details given herein, but may be modified within the scope and equivalence of the appended claims.

The invention claimed is:

1. A variable displacement swash-plate compressor comprising:

a housing having a swash plate chamber and a cylinder bore;

a drive shaft that is rotationally supported by the housing;

a swash plate that is supported in the swash plate chamber and is rotational by rotation of the drive shaft;

a link mechanism arranged between the drive shaft and the swash plate, wherein the link mechanism allows an inclination angle of the swash plate to be changed with respect to a direction perpendicular to a drive shaft axis of the drive shaft;

a piston reciprocally received in the cylinder bore;

a conversion mechanism that causes the piston to reciprocate in the cylinder bore by a stroke corresponding to the inclination angle of the swash plate through rotation of the swash plate;

an actuator configured to change the inclination angle; and a control mechanism that controls the actuator, wherein the link mechanism includes a lug member that is located in the swash plate chamber and is fixed to the drive shaft, and a transmitting member that transmits rotation of the lug member to the swash plate, the swash plate has a through hole, which slides on an outer circumference of the drive shaft in response to changes in the inclination angle, the swash plate is guided by the link mechanism and the through hole along the drive shaft axis and in a direction of the inclination angle, thereby changing the inclination angle, the actuator includes the lug member, a movable body located between the lug member and the swash plate, wherein the movable body is configured to rotate integrally with the swash plate and to move along the drive shaft axis, thereby changing the inclination angle, and a control pressure chamber that is defined by the lug member and the movable body and is configured such that pressure in the control pressure chamber is changed by the control mechanism to move the movable body, the movable body includes an acting portion that is configured to push the swash plate with the pressure in the control pressure chamber, the swash plate includes a receiving portion that contacts and is pushed by the acting portion, the acting portion and the receiving portion contact each other at an acting position, a top dead center associated part for positioning the piston at a top dead center is defined on the swash plate, and when the drive shaft and the acting position are viewed from a direction that is perpendicular to a top dead center plane containing the top dead center associated part and the drive shaft axis, the acting position is defined at a position overlapping with the drive shaft regardless of the inclination angle.

2. The variable displacement swash-plate compressor according to claim 1, wherein, when the drive shaft and the acting position are viewed from the direction that is perpendicular to the top dead center plane, the acting position is defined at a position overlapping with the drive shaft axis.

3. The variable displacement swash-plate compressor according to claim 1, wherein the movable body includes a movable body main portion, which slides on an outer circumference of the drive shaft along the drive shaft axis, the movable body main portion has an acting surface, which faces the swash plate, the swash plate includes a swash plate main portion, which actuates the conversion mechanism and has the through hole, the swash plate main portion has a receiving surface, which contacts the acting surface at a part about the through hole, the acting portion is provided on the acting surface, and the receiving portion is provided on the receiving surface.

4. The variable displacement swash-plate compressor according to claim 3, wherein the acting surface is flat, the receiving surface includes a flat section and the receiving portion, which protrudes from the flat section toward the movable body main portion, and a cross-sectional shape of the movable body along a given plane containing the drive shaft axis is line-symmetric with respect to the drive shaft axis.

5. The variable displacement swash-plate compressor according to claim 3, wherein the acting surface has a truncated conical shape with a diameter decreasing toward the drive shaft axis, the receiving surface includes a mortar portion, which has a shape that conforms to the acting surface regardless of the inclination angle, and a cross-sectional shape of the movable body along a given plane containing the drive shaft axis is line-symmetric with respect to the drive shaft axis.

6. The variable displacement swash-plate compressor according to claim 3, wherein the acting portion protrudes toward the receiving surface and, a rotation stopper is provided between the movable body main portion and the swash plate main portion, wherein the rotation stopper restricts the movable body from rotating about the drive shaft axis.

7. The variable displacement swash-plate compressor according to claim 1, wherein the acting portion is a first acting portion, a second acting portion is provided on an opposite side of the top dead center plane from the first acting portion, wherein the second acting portion constitutes a pair with the first acting portion, the receiving portion is a first receiving portion, a second receiving portion is provided on an opposite side of the top dead center plane from the first receiving portion, wherein the second receiving portion constitutes a pair with the first receiving portion, the acting position is a first acting position, a second acting position is defined on an opposite side of the top dead center plane from the first acting position, wherein the second acting position constitutes a pair with the first acting position, the first acting portion and the first receiving portion contact each other at the first acting position, and the second acting portion and the second receiving portion contact each other at the second acting position.

* * * * *